United States Patent [19]

Sugiura

[11] 4,368,940

[45] Jan. 18, 1983

[54] MULTIPURPOSE COAXIAL CONNECTOR

[75] Inventor: Shigekata Sugiura, Soma, Japan

[73] Assignee: Alps Electric Co., Ltd., Tokyo, Japan

[21] Appl. No.: 129,706

[22] Filed: Mar. 12, 1980

[30] Foreign Application Priority Data

Mar. 16, 1979 [JP] Japan ..... 54-34019[U]

[51] Int. Cl.[3] ..... H01R 17/12

[52] U.S. Cl. ..... 339/177 E

[58] Field of Search ..... 339/89 C, 90 C, 177 R, 339/177 E

[56] References Cited

U.S. PATENT DOCUMENTS

| | | | |
|---|---|---|---|
| 2,758,151 | 8/1956 | Spector et al. | 339/177 E |
| 3,402,381 | 9/1968 | Gaw et al. | 339/94 C |
| 3,453,376 | 7/1969 | Ziegler et al. | 339/177 R X |
| 3,673,546 | 6/1972 | Green et al. | 339/89 C |

*Primary Examiner*—Eugene F. Desmond

*Attorney, Agent, or Firm*—Guy W. Shoup; Gerard F. Dunne

[57] ABSTRACT

A coaxial connector characterized by comprising a main body which is attached to a terminal portion of an electric apparatus, a connecting member which is mounted on the main body and which receives a plug of a coaxial cable; and a spacer, a sealing rubber member and a cap which constitute an adapter, so that a coaxial connector can be formed by combining the main body and the connecting member or that an antenna stub penetrating through the sealing rubber member can be fixed to the main body watertightly by screwing the cap into the main body and sandwiching the sealing rubber member between this cap and the spacer inserted in the main body.

4 Claims, 5 Drawing Figures

MULTIPURPOSE COAXIAL CONNECTOR

BACKGROUND OF THE INVENTION

The present invention relates to coaxial connectors which may be put to a great many different uses.

Coaxial connectors connect coaxial cables, and when the matching of characteristic impedance is taken into account, they can be used to connect cables carrying signals of frequencies up to 4 GHz, 10 GHz, or higher. By way of example, one known coaxial connector is adapted to be mounted to the input of a converter for handling signals in the UHF region. This known connector receives a plug disposed at the terminal of the coaxial cable carrying a radio-frequency input signal from an antenna, and it introduces the signal from the antenna into the converter. In order to reduce to the utmost the losses of the radio-frequency signal led from the antenna, the converter of this type is often modified so that the antenna may be installed directly on the input end of the converter and thereby dispense with the coaxial cable which often causes large losses. In such cases, there is the inconvenience that after the coaxial connector mounted on the input end of the converter has been detached, the converter must be attached to a part of the antenna such as its reflector. However, the characteristic impedance of the antenna and converter must be carefully matched and this often presents difficulties.

Regarding a connector which can eliminate such inconvenience, U.S. Patent Application Ser. No. 076,416, now abandoned, has been filed on Sept. 17, 1979 by the same applicant as in the present case. The present invention consists in further improvements relating to the aforecited application.

SUMMARY OF THE INVENTION

An object of the present invention is to provide a multipurpose connector which can receive a plug attached to the terminal of a coaxial cable and which also permits another component of an antenna or the like to be installed thereon.

Another object of the present invention is to provide a connector which can maintain the matching of characteristic impedances for the plug of a coaxial cable and also for other components.

Still another object of the present invention is to provide a connector which has a structure adapted to prevent water from entering the connector even when the connector is used in such moisture prone places as outdoors.

Further objects and advantages of the present invention will become apparent from the accompanying drawings and the following description taken in conjunction therewith.

PREFERRED EMBODIMENT OF THE INVENTION

Now, an embodiment of the present invention will be described in detail with reference to the drawings.

Figure 1A:
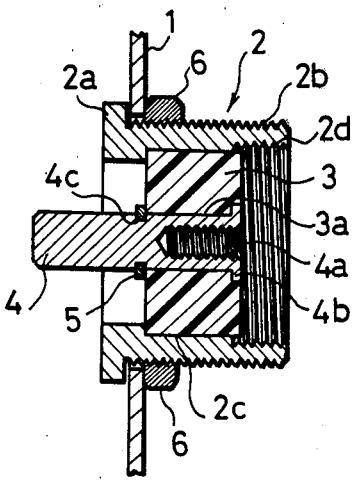
FIG. 1(A) is a sectional view of the main body of a connector according to the present invention.
Figure 1B:
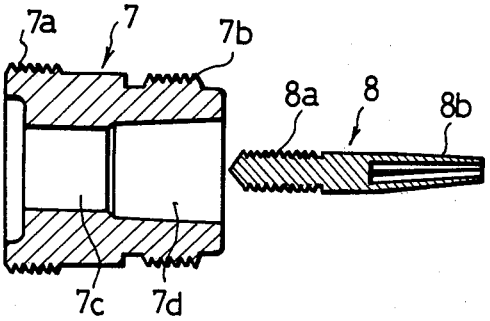
FIG. 1(B) is a sectional view of the connecting member of the connector according to the present invention.
Figure 1C:
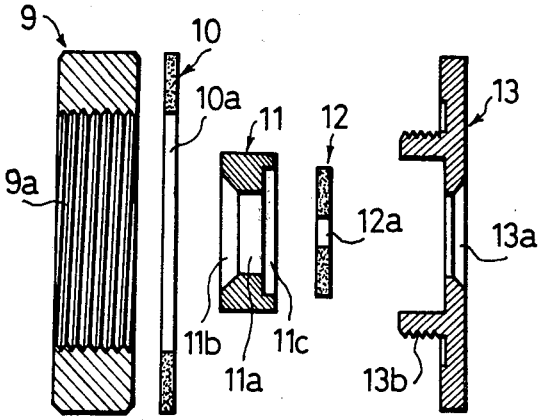
FIG. 1(C) is a sectional view of the adapter of the connector according to the present invention.

FIGS. 1(A) to 1(C) are sectional views showing an embodiment of the present invention. Among them, FIG. 1(A) is a sectional view of the main body of a connector according to the present invention. In the figure, numeral 1 designates the chassis of a device such as converter to which the coaxial connector is attached. Numeral 2 designates an outer shell which is formed by drilling a brass blank into a substantially cylindrical shape, and the outer surface of which is plated with silver to a thickness of 5 μm or larger. The outer shell 2 is formed at its one end with a flange portion 2*a* extending outwards, and is formed in its outer peripheral surface with a threaded portion 2*b*. In addition, a stepped portion 2*c* is recessed in the central part of the inner surface of the outer shell 2, and a threaded portion 2*d* is formed on the inner peripheral surface of that end part of the outer shell 2 which is opposite to the flange portion 2*a*. Shown at 3 is a spacer which is formed into a cylindrical shape, and which is made of a synthetic resin such as a fluorocarbon resin exhibiting small losses for high-frequency signals. A through bore 3*a* of a circular cross-section is formed in the central part of the spacer 3. Numeral 4 denotes a central conductor which is fitted in the through bore 3*a* of the spacer 3. The central conductor 4 is made of copper, and its surface is plated with silver to a thickness of 5 μm or larger. The central conductor 4 is formed with a threaded bore 4*a* in the central part thereof, with a rib 4*b* at one end thereof, and with a circumferential groove 4*c* at an intermediate part thereof. A holder ring 5 is fitted in the groove 4*c*, and the central conductor 4 fitted in the through bore 3*a* of the spacer 3 and is fixed to the spacer 3 by means of the holder ring 5 as well as the rib 4*b* seating within a mating recess in the spacer 3. A nut 6 is screwed onto the threaded portion 2*b* of the outer shell 2, to fix the latter to the chassis 1. The outer shell 2, the spacer 3 and the central conductor 4 constructed in this manner constitute the main body A of the coaxial connector.

FIG. 1(B) is a sectional view of a connecting member. In the figure, numeral 7 indicates a cylindrical body which is formed by drilling a brass blank into a substantially cylindrical shape, and the surface of which is plated with silver to a thickness of 5 μm or larger. The cylindrical body 7 is formed with threaded portions 7*a* and 7*b* at both its ends. Inside the cylindrical body 7, there are formed an inner cylinder 7*c* which is drilled to be cylindrical and a connecting portion 7*d* which has an inclination widening in the outward direction. A central conductor 8 is made of copper, and is plated with silver to a thickness of 5 μm or larger. A threaded portion 8*a* is formed at one end of the central conductor 8, while a clip portion 8*b* is formed at the other end. The cylindrical body 7 and the central conductor 8 constitute the connecting member B.

FIG. 1(C) is a sectional view of an adapter. In the figure, numeral 9 denotes a locating ring made of metal, which has a threaded bore 9*a* in the central part thereof. This bore 9*a* is adapted to threadably engage the threaded portion 2*b* of the outer shell 2. A packing made of rubber 10 is provided in its central part with a circular bore 10*a* through which the outer shell 2 extends. A spacer 11 made of metal is plated with silver similarly to the outer shell 2. A cylindrical bore 11*a* is formed in the central part of the spacer 11. A cone-shaped matching portion 11*b* is formed at one end of the cylindrical bore 11*a*, while an indent 11*c* is formed at the other end. Shown at 12 is a disc-shaped sealing member made of rubber, which has a circular bore 12*a* in its central part. Numeral 13 indicates a cap made of metal. The cap 13 is provided in its central part with a through portion 13*a* having a conical inclined surface, and on its rear side with a threaded portion 13*b*.

Now, the operation of the present invention will be described.

First, there will be explained a case where the present invention is applied as a coaxial connector for receiving a plug attached to the terminal of a coaxial cable.

Figure 2:
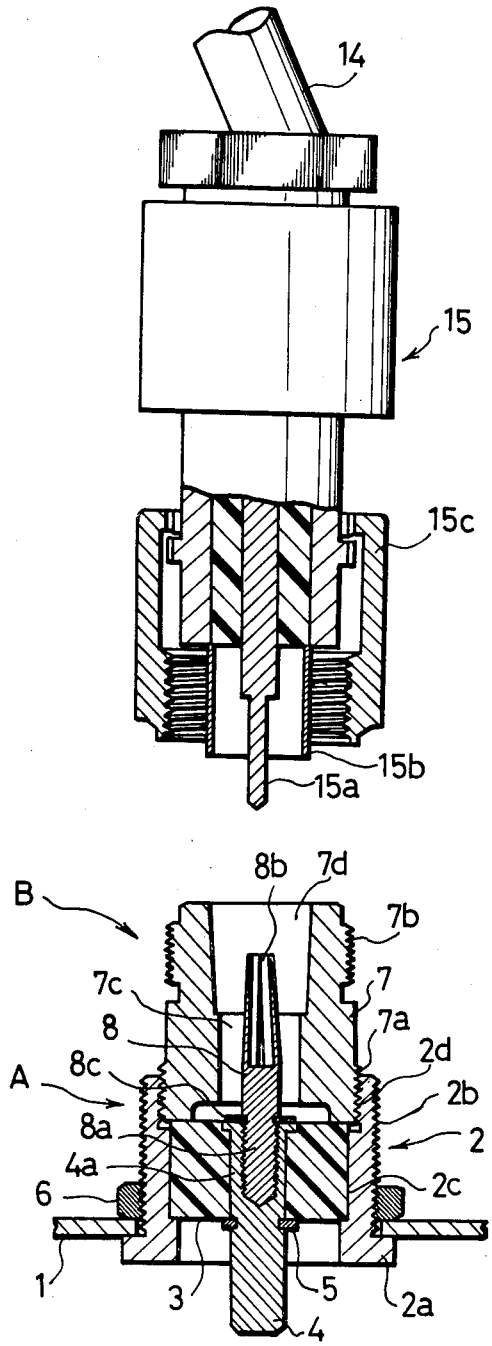
FIG. 2 is a sectional view showing the state in which the connector according to the present invention and a coaxial cable are connected.

As shown in FIG. 2, the outer shell 2 of the main body A is inserted through a bore provided in the chassis 1 of the converter, from the inner side of the converter, and the nut 6 is screwed onto the threaded portion 2*b*, thereby to fix the main body A to the chassis 1. Thereafter, the threaded portion 8*a* of the central conductor 8 is screwed into the threaded bore 4*a* provided in the central conductor 4. At this time, a spring washer 8*c* is interposed to prevent the central conductors 4 and 8 from loosening. Subsequently, the threaded portion 7*a* of the cylindrical body 7 is screwed into the threaded portion 2*d* of the outer shell 2 so as to couple the outer shell 2 and the cylindrical body 7 and also to prevent the spacer 3 from falling out owing to the pressing of the cylindrical body 7 against the spacer 3. Thus, the coaxial connector can be constructed.

A plug 15 installed on the end of the coaxial cable 14 is joined to the connecting member B of the coaxial connector constructed as described above. More specifically, the fore end of the central conductor 15*a* of the plug 15 is inserted into the clip portion 8*b* of the central conductor 8. At the same time, an outer conductor 15*b* made up of a resilient piece is fitted into the connecting portion 7*d* of the cylindrical body 7. Then, a screw body 15*c* loosely fitted to the plug 15 is screwed onto the threaded portion 7*b* of the cylindrical body 7, thereby to connect the coaxial connector and the plug to each other.

Secondly, there will be explained a case where an antenna is directly attached to the input terminal of the converter by the use of the adapter of the present invention.

Figure 3:
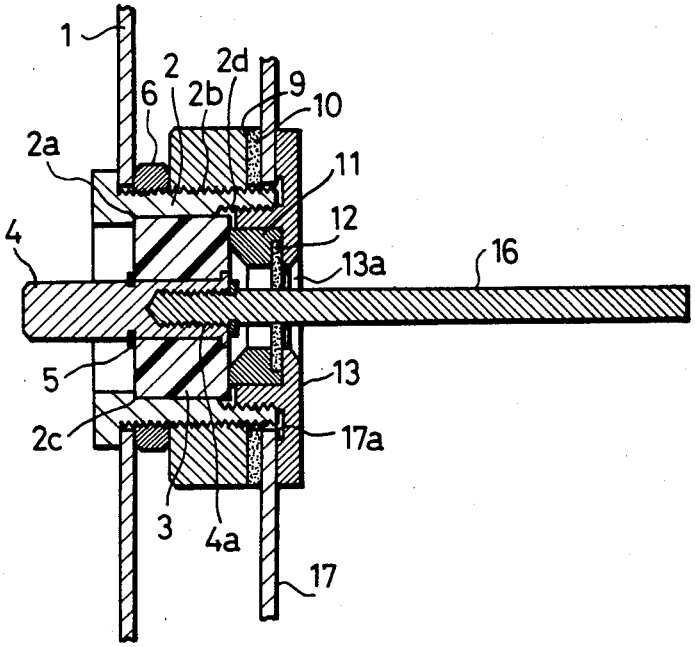
FIG. 3 is a sectional view showing the state in which an antenna is mounted on the connector according to the present invention.

The cylindrical body 7 and the central conductor 8 of the connecting member B which has been screwed to the coaxial connector attached to the input terminal of the converter are removed. Thereafter, as illustrated in FIG. 3, the locating ring 9 forming the adapter is screwed onto the threaded portion 2*b* of the outer shell 2, whereupon the packing 10 is fitted onto the outer shell 2. Subsequently, the threaded portion of an antenna stub 16 is screwed into the threaded bore 4*a* of the central conductor 4 so as to fix the antenna stub. Thereafter, the antenna stub 16 is inserted through the cylindrical bore 11*a* of the spacer 11 to fit the spacer 11 into the outer shell 2, and it is inserted through the circular bore 12*a* of the sealing rubber member 12 to fit the sealing rubber member 12 into the indent 11*c* of the spacer 11. At this time, the bore 12*a* of the sealing rubber member 12 is smaller than the diameter of the antenna stub 16, so that the sealing rubber member 12 is snugly fitted on the antenna stub.

Lastly, after fitting the outer shell 2 into a bore 17*a* provided in the reflector plate 17 of the antenna, the antenna stub 16 is inserted through the through portion 13*a* of the cap 13, and the threaded portion 13*b* of the cap 13 is screwed onto the threaded portion 2*d* of the outer shell 2, so that the locating ring 9 is screwed up towards the reflector plate 17 of the antenna to tighten the reflector plate 17 of the antenna by means of the locating ring 9 and the cap 13 and to fix it to the main body A.

As described above in detail, according to the present invention, when the main body is attached to the terminal portion of the device such as converter in advance, the connector for the coaxial cable can be formed merely by combining the main body A with the connecting member B. In addition, when the connecting member is detached from the main body and the adapter is attached to the latter, the antenna can be directly mounted on the main body, and also the reflector plate of the antenna can be mounted. Moreover, the sealing rubber member is sandwiched between the cap screwed in the main body and the spacer inserted therein, and the antenna stub penetrates through the sealing rubber member watertightly, so that even when the connector according to the present invention is exposed to the open air, no water enters the connector. In this way, the waterproof structure can be formed very simply. The present invention brings forth such important effects.

What is claimed is:

1. In a connector assembly comprising a main body adapted to be attached to a terminal of an electric apparatus; means including a connecting member attachable to the main body for receiving a plug connected to a coaxial cable for connecting said cable electrically to said terminal; and means including an adapter attachable to said main body for connecting a component other than said plug to said terminal; whereby a coaxial connector for receiving said plug can be formed at the terminal of said electric apparatus by means of said main body and said connecting member, or a connector for attaching a component other than said plug can be formed at the terminal of said electric apparatus by means of said main body and said adapter;

the improvement wherein said main body is comprised of a cylindrical member having a hollow portion receiving a first spacer member holding a central conductor, said hollow portion having an external thread on its outer surface and an internal thread on its inner surface, and said adapter is comprised of a locator ring adapted to be threaded onto said external thread, a cap adapted to be threaded onto said internal thread, and a second spacer member and a sealing member received in said cap, said cap being threaded onto said main body to bring said second spacer of said adapter and said first spacer of said main body into pressed contact and to sandwich said sealing member between said second spacer and said cap.

2. A connector assembly as defined in claim 1, said component being an antenna having an antenna stub adapted to penetrate through said adapter and be fixed to said central conductor of said main body.

3. A connector assembly as defined in claim 2, wherein said sealing member is provided with a bore having a diameter smaller than that of said antenna stub, and said antenna stub being adapted to penetrate through said bore in a water tight manner.

4. A connector assembly as defined in claim 2, wherein said main body includes a central conductor having a threaded portion adapted to threadably engage a threaded portion of said antenna stub.

* * * * *